US010861406B2

(12) United States Patent
Xi et al.

(10) Patent No.: US 10,861,406 B2
(45) Date of Patent: Dec. 8, 2020

(54) DISPLAY APPARATUS AND DRIVING METHOD OF DISPLAY PANEL THEREOF

(71) Applicant: Au Optronics Corporation, Hsinchu (TW)

(72) Inventors: Peng-Bo Xi, Taipei (TW); Sung-Yu Su, Tainan (TW); Feng-Ming Hsu, Hsinchu County (TW); Hsin-Chang Chen, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/234,582

(22) Filed: Dec. 28, 2018

(65) Prior Publication Data

US 2019/0206351 A1 Jul. 4, 2019

(30) Foreign Application Priority Data

Dec. 29, 2017 (TW) ..... 106146637 A

(51) Int. Cl.
*G09G 3/36* (2006.01)

(52) U.S. Cl.
CPC ..... *G09G 3/3655* (2013.01); *G09G 2358/00* (2013.01)

(58) Field of Classification Search
None
See application file for complete search history.

(56) References Cited

U.S. PATENT DOCUMENTS 8,248,336 B2 8/2012 Hwang et al.
8,654,159 B2 2/2014 Hwang et al.
2004/0239667 A1* 12/2004 Takahashi ..... G09G 3/3655 345/212
2008/0094332 A1* 4/2008 Tseng ..... G09G 3/3614 345/89
2008/0136804 A1* 6/2008 Lee ..... G09G 3/3655 345/211
2011/0115778 A1* 5/2011 Yang ..... G09G 3/3655 345/212

(Continued)

FOREIGN PATENT DOCUMENTS

CN 102540599 7/2012
CN 102608818 7/2012
CN 106448601 2/2017

*Primary Examiner* — Kent W Chang
*Assistant Examiner* — Benjamin Morales
(74) *Attorney, Agent, or Firm* — JCIPRNET

(57) ABSTRACT

A display apparatus and a driving method of a display panel thereof are disclosed. The display apparatus includes the display panel and a common voltage setting circuit. The display panel has a plurality of pixels and a plurality of common electrode lines and receives a plurality of pixel voltages. Each of the pixels is coupled to the corresponding common electrode line and receives the corresponding pixel voltage. The common voltage setting circuit is coupled to the common electrode lines. A common voltage having a normal voltage level is supplied to the common electrode lines during a first frame period. The common voltage having a complementary high voltage level or a complementary low voltage level is supplied to the common electrode lines during a second frame period. Each of the pixels receives the same pixel voltage during the first frame period and the second frame period.

19 Claims, 5 Drawing Sheets

(56) References Cited

U.S. PATENT DOCUMENTS

| | | | | |
|---|---|---|---|---|
| 2012/0154467 | A1* | 6/2012 | Hwang | G09G 3/3659 345/694 |
| 2012/0242641 | A1* | 9/2012 | Lee | G09G 3/3655 345/212 |
| 2013/0257701 | A1 | 10/2013 | Wang et al. | |
| 2015/0042238 | A1* | 2/2015 | Chuang | G09G 3/3614 315/291 |
| 2015/0138059 | A1 | 5/2015 | Large et al. | |
| 2015/0187291 | A1* | 7/2015 | Jang | G09G 3/3655 345/694 |
| 2015/0193625 | A1* | 7/2015 | Sumi | G06F 21/60 345/697 |
| 2018/0096662 | A1* | 4/2018 | Lee | G09G 3/3648 |
| 2019/0278117 | A1* | 9/2019 | Chung | G09G 3/3659 |

* cited by examiner

DISPLAY APPARATUS AND DRIVING METHOD OF DISPLAY PANEL THEREOF

CROSS-REFERENCE TO RELATED APPLICATION

This application claims the priority benefit of Taiwan application serial no. 106146637, filed on Dec. 29, 2017. The entirety of the above-mentioned patent application is hereby incorporated by reference herein and made a part of this specification.

BACKGROUND OF THE DISCLOSURE

1. Field of the Disclosure

The disclosure relates to a display apparatus and particularly relates to a display apparatus and a driving method of a display panel of the display apparatus.

2. Description of Related Art

In general, a display usually exhibits a display effect of a wide viewing angle so as to provide a screen for a plurality of viewers. However, in certain circumstances, for example, when confidential information is being viewed, or a password is being entered, the display effect of a wide viewing angle makes confidential information vulnerable to onlookers and causes the leakage of confidential information. Therefore, in order to prevent prying eyes, the display apparatus shall have an anti-peep feature.

SUMMARY OF THE DISCLOSURE

The disclosure provides a display apparatus capable of performing an anti-peep function and a driving method of a display panel of the display apparatus.

The display apparatus according to an embodiment of the disclosure includes a display panel and a common voltage setting circuit. The display panel has a plurality of pixels and a plurality of common electrode lines and receives a plurality of pixel voltages. Each of the pixels is coupled to the corresponding common electrode line, and receives the corresponding pixel voltage. The common voltage setting circuit is coupled to the common electrode lines. The common voltage having a normal voltage level is supplied to the common electrode lines during a first frame period. The common voltage having a complementary high voltage level or a complementary low voltage level is supplied to the common electrode lines during a second frame period. The normal voltage level, the complementary high voltage level and the complementary low voltage level are different from one another, and each of the pixels receives the same pixel voltage during the first frame period and the second frame period.

In the driving method of a display panel according to an embodiment of the disclosure, the display panel has a plurality of common electrode lines and a plurality of pixels and receives a plurality of pixel voltages. Each of the pixels is coupled to the corresponding common electrode line and receives the corresponding pixel voltage. The driving method includes the following steps: A common voltage having a normal voltage level is supplied to the common electrode lines during a first frame period. The common voltage having a complementary high voltage level or a complementary low voltage level is supplied to the common electrode lines during a second frame period. The normal voltage level, the complementary high voltage level and the complementary low voltage level are different from one another, and each of the pixels receives the same pixel voltage during the first frame period and the second frame period.

In view of the foregoing, in terms of the display apparatus and the driving method of the display panel of the display apparatus according to the embodiments of the disclosure, the common voltage having the normal voltage level is supplied to the common electrode lines of the display panel during the first frame period, the common voltage having the complementary high voltage level or the complementary low voltage level is supplied to the common electrode lines during the second frame period, and the pixel receives the same pixel voltage during the first frame period and the second frame period. In this regard, a viewer on either side of the display panel sees only a grayscale screen of a certain range or a single-grayscale screen. That is, the viewer on either side of the display panel cannot see the screen normally. In that case, the display apparatus provides the anti-peep function.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
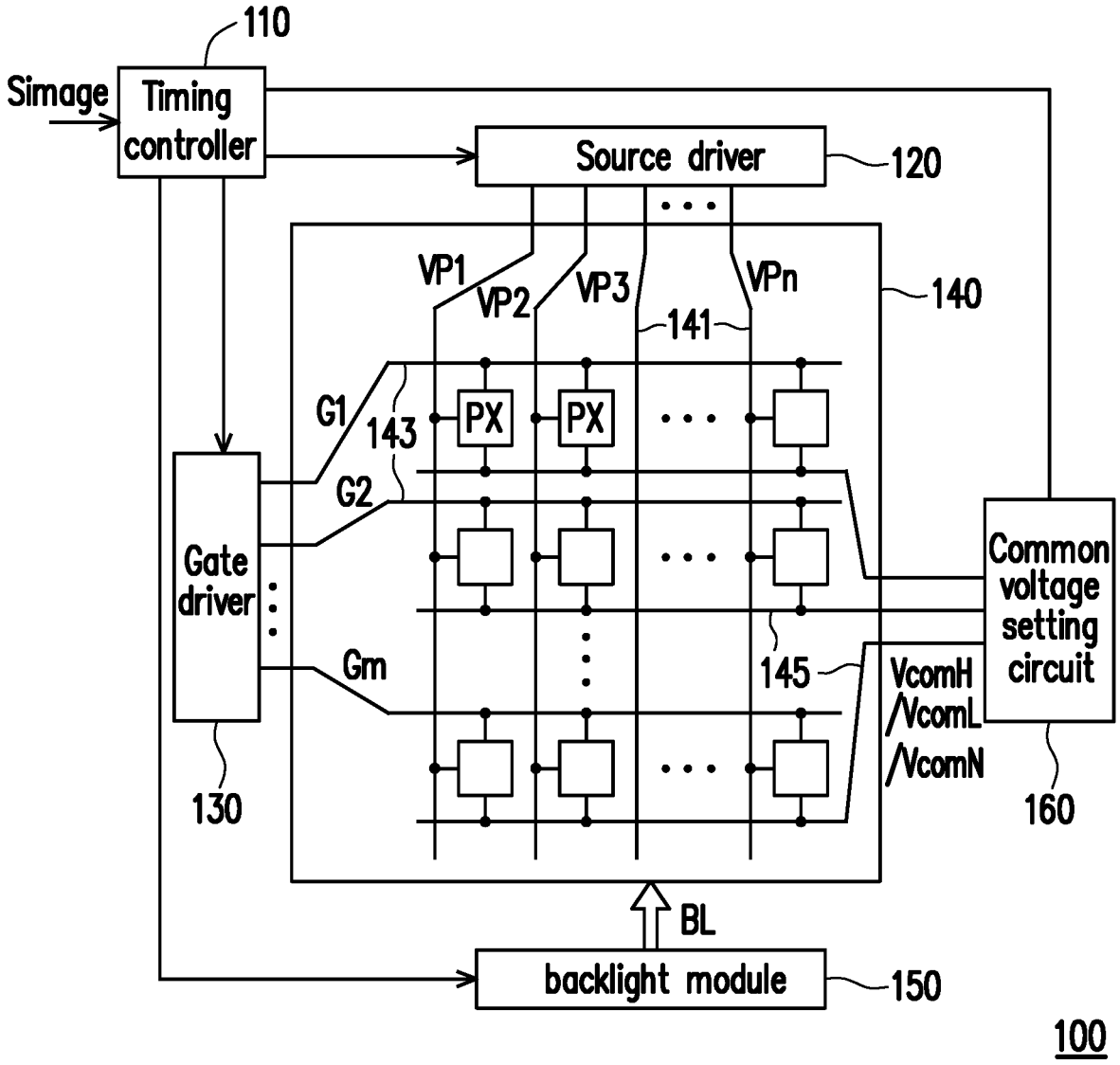
FIG. 1 is a schematic view of a system of a display apparatus according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is schematic view of a system of a display apparatus according to an embodiment of the disclosure. Referring to FIG. 1, in the embodiment, a display apparatus 100 includes a timing controller 110, a source driver 120, a gate driver 130, a display panel 140, a backlight module 150 and a common voltage setting circuit 160. The timing controller 110 receives an image signal Simage, and is coupled to the source driver 120, the gate driver 130, the backlight module 150 and the common voltage setting circuit 160.

The timing controller 110 controls the source driver 120 to supply a plurality of pixel voltages VP1 to VPn to the display panel 140 according to the received image signal Simage, wherein n is a positive integer. The timing controller 110 controls the gate driver 130 to supply a plurality of scan signals G1 to Gm to the display panel 140, wherein m is a positive integer. The timing controller 110 controls the backlight module 150 to supply a display light BL to the display panel 140. Moreover, the timing controller 110 controls the common voltage setting circuit 160 to supply common voltages having a normal voltage level VcomN, a complementary high voltage level VcomH and a complementary low voltage level VcomL that are different from one another to the display panel 140.

The display panel 140 includes a plurality of pixels PX, a plurality of data lines 141, a plurality of scan lines 143 and a plurality of common electrode lines 145. The data line 141 is coupled to the source driver 120 to receive the pixel voltages VP1 to VPn respectively. The scan line 143 is coupled to the scan driver 130 to receive scan signals G1 to Gm respectively. The common electrode line 145 is coupled to the common voltage setting circuit 160 to receive the common voltage having one of the normal voltage level VcomN, the complementary high voltage level VcomH and the complementary low voltage level VcomL.

Each of the pixels PX is coupled to the corresponding data line 141, the corresponding scan line 143 and the corresponding common electrode line 145 respectively to receive a corresponding pixel voltage (such as VP1 to VPn), a corresponding scan signal (such as G1 to Gm) and a corresponding common voltage.

Figure 2A:
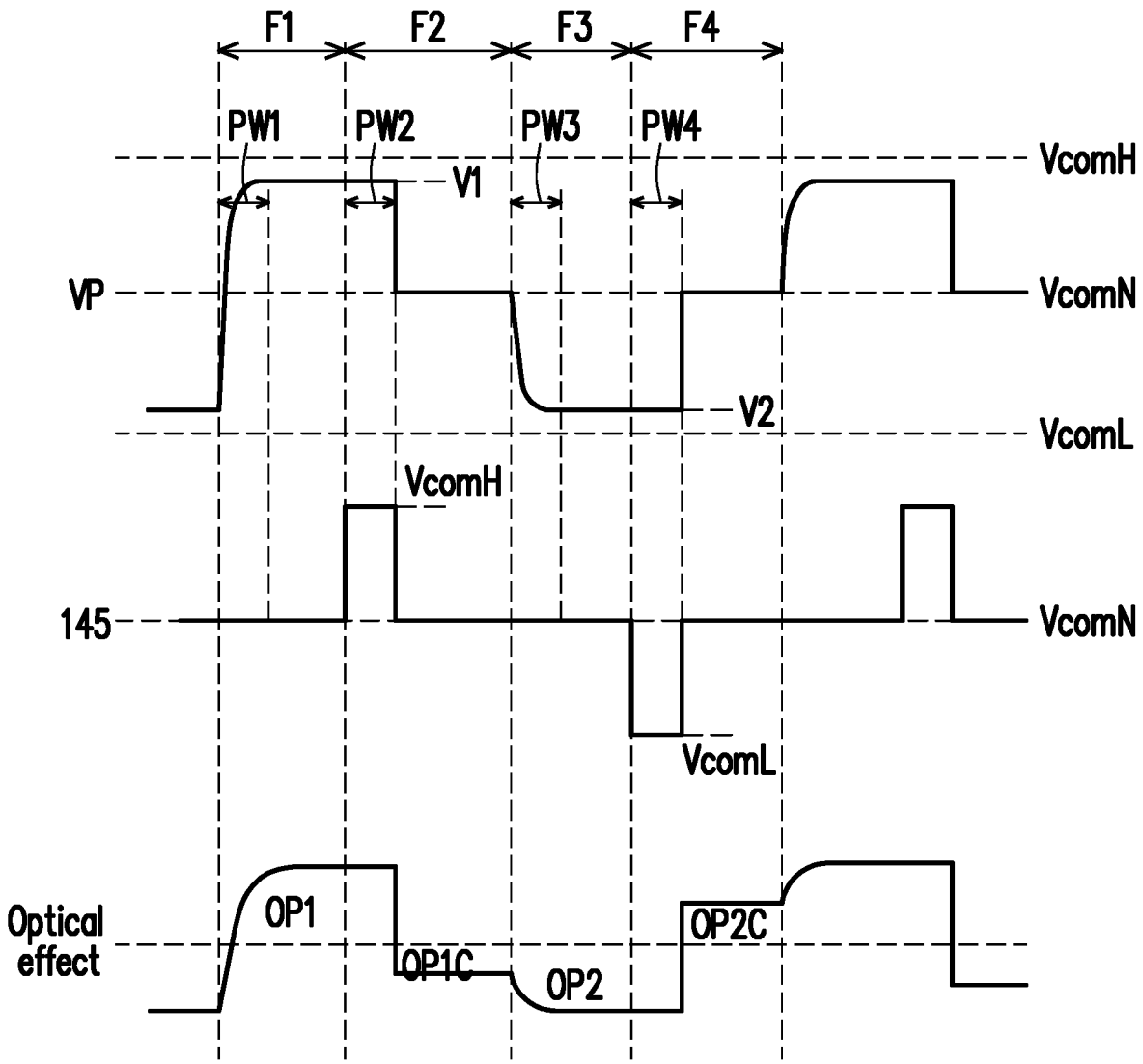
FIG. 2A is a schematic view of a display effect of a pixel of a display panel according to an embodiment of the disclosure.

FIG. 2A is a schematic view of a display effect of a pixel of a display panel according to an embodiment of the disclosure. Referring to FIGS. 1 and 2A, in the embodiment, the single pixel PX is taken as an example, and the same pixel voltage VP is supplied to (or written into) the pixel PX during a first frame period F1 and a second frame period F2. Furthermore, the source driver 120 supplies the pixel voltage VP of a positive polarity (relative to the normal voltage level VcomN) such as a voltage V1 in FIG. 2A during the first frame period F1 and the second frame period F2.

During a writing period PW1 of the first frame period F1, the common voltage has the normal voltage level VcomN, so a voltage difference between the pixel electrode of the pixel PX and the common electrode is V1-VcomN. During a writing period PW2 of the second frame period F2, the common voltage has the complementary high voltage level VcomH. If the complementary high voltage level VcomH corresponds to the highest gamma voltage, that is, the pixel voltage VP of the positive polarity is generally between the complementary high voltage level VcomH and the normal voltage level VcomN, or the complementary high voltage level VcomH is greater than or equal to the normal voltage level VcomN and any grayscale pixel voltage VP, a voltage difference between the pixel electrode of the pixel PX and the common electrode is VcomH-V1.

Next, the source driver 120 supplies the pixel voltage VP of a negative polarity (relative to the normal voltage level VcomN) such as a voltage V2 in FIG. 2A during a third frame period F3 and a fourth frame period F4. During a writing period PW3 of the third frame period F3, the common voltage has the normal voltage level VcomN, so a voltage difference between the pixel electrode of the pixel PX and the common electrode is V2-VcomN. During a writing period PW4 of the fourth frame period F4, the common voltage has the complementary low voltage level VcomL. If the complementary low voltage level VcomL corresponds to the lowest gamma voltage, that is, the pixel voltage VP of the negative polarity is generally between the complementary low voltage level VcomL and the normal voltage level VcomN, or the complementary low voltage level VcomL is less than or equal to the normal voltage level VcomN and any grayscale pixel voltage VP, a voltage difference between the pixel electrode of the pixel PX and the common electrode is VcomL-V2.

Figure 2B:
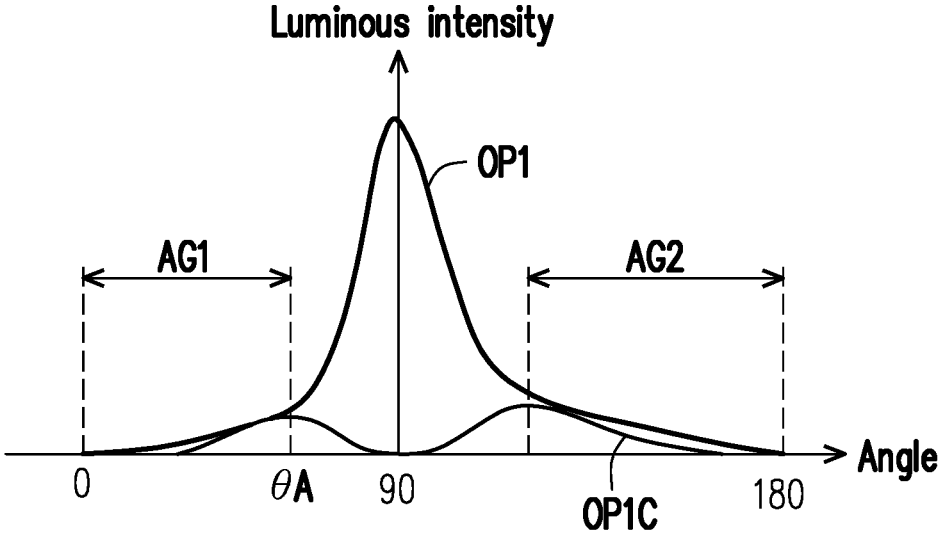
FIG. 2B is a schematic view of an optical effect of a pixel of a display panel according to an embodiment of the disclosure.

FIG. 2B is a schematic view of an optical effect of light emitted by a backlight module of a display panel according to an embodiment of the disclosure. Referring to FIGS. 2A and 2B, in the embodiment, an optical effect of the single pixel PX is taken as an example. Furthermore, FIG. 2B illustrates a distribution relation between a luminous intensity of backlight from the backlight module and an angle. In FIG. 2B, a first distribution curve OP1 shows that the luminous intensity is higher from front views (that is, the viewer is at an angle of 90 degrees with respect to the display panel) and decreases with variations of the angle toward the two ends; a complementary distribution curve OP1C shows that the luminous intensity is the highest from side views (such as at specific angles of θA and θB) and lower from front views.

Through the above operation, a viewer on the front mainly sees an image generated according to backlight having the first distribution curve OP1, while a viewer on the side sees an image generated according to backlight having the complementary distribution curve OP1C. For this reason, the viewer on the side of the display panel 140 may see only a grayscale screen of a certain range (such as grayscale values of 120-130) or a signale-grayscale screen (such as a grayscale value of 125). For this reason, switching the common voltage into one of the normal voltage level VcomN, the complementary high voltage level VcomH and the complementary low voltage level VcomL alternately makes the viewer on the side unable to see the screen normally. In that case, the display apparatus 100 provides an anti-peep function.

In other words, when the pixel PX coupled to each of the common electrode lines 145 is written with the pixel voltage VP of the positive polarity respectively, each of the common electrode lines 145 receives the common voltage having the normal voltage level VcomN during the first frame period (such as the first frame period F1), and the display light BL of the backlight module 150 exhibits a normal light field to allow each of the pixels PX to exhibit a normal display image according to the corresponding received pixel voltage VP and the normal voltage level VcomN. During the second frame period (such as the second frame period F2) following shortly the first frame period, each of the common electrode lines 145 receives the common voltage having the complementary high voltage level VcomH, and the display light BL of the backlight module 150 exhibits a viewing angle control (VAC) light field to allow each of the pixels PX corresponding to the common voltage in an alternating state to exhibit complementary images of complementary colors at specific angles.

When the pixel PX coupled to each of the common electrode lines 145 is written with the pixel voltage VP of the negative polarity, each of the common electrode lines 145 receives the common voltage having the normal voltage level VcomN during the first frame period (such as the third frame period F3), and during the second frame period following shortly, each of the common electrode lines 145 receives the common voltage having the complementary low voltage level VcomL.

In the above embodiment, the common voltage setting circuit 160 supplies the common voltage switched to one of the normal voltage level VcomN, the complementary high voltage level VcomH and the complementary low voltage level VcomL alternately to enable the display apparatus 100 to perform the anti-peep function. Therefore, when a user intends to switch off the anti-peep function, the function of setting up alternate voltages by the common voltage setting circuit 160 is switched off (that is, the common voltage is merely set as the normal voltage level VcomN).

Based on the above, from front views, by adjusting light emitted by the backlight module 150 through the pixel PX, the user may see the normal display image. With the viewing angle of the user shifting toward the two ends, the user cannot see the normal display image clearly, and at angles from 0 to θA degree, and θB to 180 degrees, the user sees only a specific grayscale screen. In other words, the angles from 0 to θA degree, and from θB and 180 degrees provide effective anti-peep regions AG1 and AG2 with desired anti-peep effects.

Figure 3:
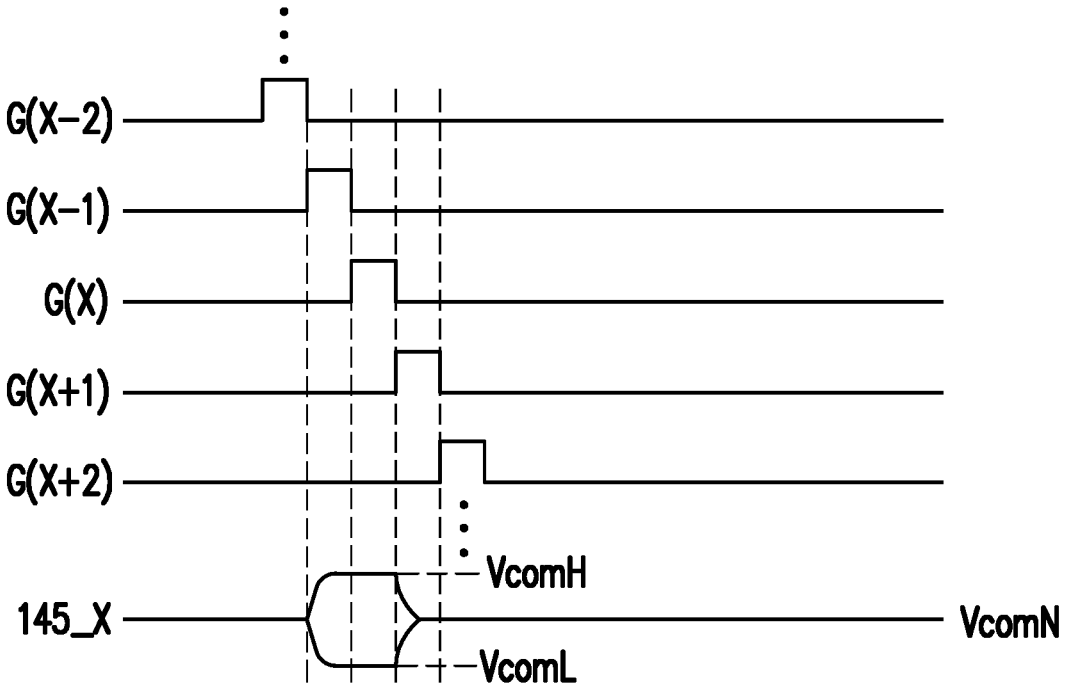
FIG. 3 is a schematic view of drive waveforms of a display panel according to an embodiment of the disclosure.

FIG. 3 is a schematic view of drive waveforms of a display panel according to an embodiment of the disclosure. Referring to FIGS. 1-3, FIG. 3 is configured to illustrate the movement during the second frame period F2 and the fourth frame period F4 in FIG. 2A, and the common electrode line 145 of the display panel 140 is switched to the complementary high voltage level VcomH or the complementary low voltage level VcomL row by row. In the embodiment, the pixel PX receiving a scan signal G(x) serves as an example, wherein x is a positive integer. Furthermore, a former scan signal G(x−1) is enabled, the timing controller 110 may control the common voltage setting circuit 160 to set the common voltage received by the corresponding common electrode line 145_*x* as the complementary high voltage level VcomH or the complementary low voltage level VcomL. Next, when a later scan signal G(x+1) is enabled, the timing controller 110 may control the common voltage setting circuit 160 to restore the common voltage received by the corresponding common electrode line 145_*x* to the normal voltage level VcomN.

In other words, during the second frame period F2 and the fourth frame period F4, before each of the pixel voltages VP is written into the corresponding pixel PX, the common voltage received by the corresponding common electrode line 145_*x* is switched from the normal voltage level VcomN to the complementary high voltage level VcomH or the complementary low voltage level VcomL. Moreover, after each of the pixel voltages VP is written into the corresponding pixel PX, the common voltage received by the corresponding common electrode line 145_*x* is switched from the complementary high voltage level VcomH or the complementary low voltage level VcomL to the normal voltage level VcomN.

Based on the above, in the case of a desired operation, during the second frame period F2 and the fourth frame period F4 in FIG. 2A, one of the common electrode lines 145 receives the common voltage having the complementary high voltage level VcomH or the complementary low voltage level VcomL, and the rest of the common electrode lines 145 receive the common voltage having the normal voltage level VcomN.

In the embodiment, a voltage level is switched through the former scan signal G(x−1) and the later scan signal G(x+1), but in other embodiments, the voltage level may be switched through the former two scan signals G(x−2) and the later two scan signals G(x+2). The operation depends on circuit design, but the embodiment of the disclosure is not limited thereto.

In addition, in the embodiment, the common electrode line 145 of the display panel 140 is switched to the complementary high voltage level VcomH or the complementary low voltage level VcomL row by row. Therefore, in some embodiments, the normal voltage level VcomN, the complementary high voltage level VcomH or the complementary low voltage level VcomL may be transmitted to the corresponding common electrode line 145 by a shift register. The complementary high voltage level VcomH and the complementary low voltage level VcomL may be determined based on a polar signal (not shown) received by the display apparatus 100, but the embodiment of the disclosure is not limited thereto.

Figure 4:
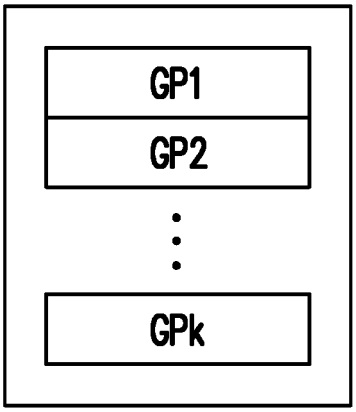
FIG. 4 is a schematic view of grouping of a display panel according to an embodiment of the disclosure.

FIG. 4 is a schematic view of grouping of a display panel according to an embodiment of the disclosure. Referring to FIGS. 1 and 4, in the embodiment, the display panel 140 may be divided into several groups (such as GP1 to GPk). That is, the common electrode line 145 may be divided into a plurality of common electrode groups (such as GP1 to GPk), wherein k is a positive integer. Each common electrode group may correspond to a plurality of scan lines. For example, a common electrode group corresponds to eight scan lines. Allowing each common electrode groups to correspond to a plurality of scan lines may shrink the area occupied by a required common circuit.

Figure 5:
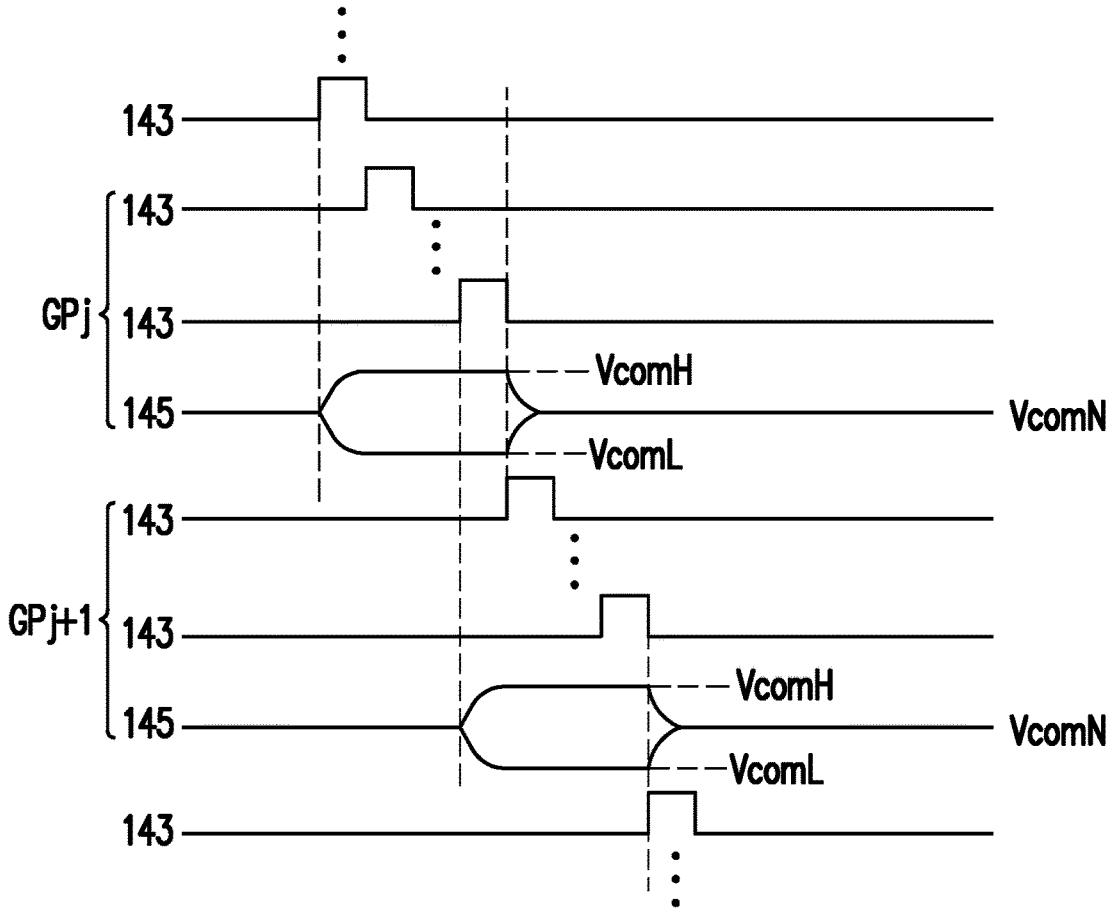
FIG. 5 is a schematic view of drive waveforms of a display panel according to an embodiment of the disclosure.

FIG. 5 is a schematic view of drive waveforms of a display panel according to an embodiment of the disclosure. Referring to FIGS. 1, 2A, 4 and 5, FIG. 5 is configured to illustrate the movement during the second frame period F2 and the fourth frame period F4 in FIG. 2A, and the common electrode line 145 of the display panel 140 is switched to the complementary high voltage level VcomH or the complementary low voltage level VcomL group by group. In the embodiment, a group GPj serves as an example, wherein j is a positive integer. Furthermore, when the former scan signal (such as G1 to Gm) received by the former scan line 143 of the group GPj is enabled, the timing controller 110 may control the common voltage setting circuit 160 to set the common voltage received by one or more of the common electrode lines 145 to which the group GPj corresponds as the complementary high voltage level VcomH or the complementary low voltage level VcomL. Next, when a later scan signal (such as G1 to Gm) received by the later scan line 143 (included in a later group GPj+1) of the group GPj is enabled, the timing controller 110 may control the common voltage setting circuit 160 to restore the common voltage received by one or more of the common electrode lines 145 to which the group GPj corresponds to the normal voltage level VcomN.

In other words, in the case of a desired operation, during the second frame period F2 and the fourth frame period F4 in FIG. 2A, the common electrode line 145 of one of the common electrode groups (such as GP1 to GPk) receives the common voltage having the complementary high voltage level VcomH or the complementary low voltage level VcomL, and the common electrode line 145 of the rest of the common electrode groups (such as GP1 to GPk) receives the common voltage having the normal voltage level VcomN.

In the embodiment, the backlight module 150 is configured to provide the display light BL for the pixel PX written with the pixel voltages VP1 to VPn while each of the pixel voltages VP1 to VPn is written into the corresponding pixel PX, so the display panel 140 may exhibit an image. However, considering liquid crystal response time, the display light BL may be provided after the pixel voltages VP1 to VPn are written into the corresponding pixel PX for a liquid crystal response time.

For instance, if the backlight module 150 is to provide the single display light BL, the backlight module 150 may provide the display light BL after all the pixels PX are written with the pixel voltages VP1 to VPn for a liquid crystal response time. Alternatively, if the backlight module 150 is to provide the plurality of display lights BL, that is, the display panel 140 may provide the display light BL strip by strip or group by group, the backlight module 150 may provide the display light BL for each row or group (such as PG1 to PGk) after all the pixels PX in each row or group (such as PG1 to PGk) are written with the pixel voltages VP1 to VPn for a liquid crystal response time.

Based on the above, a provided time for providing the display light BL to the pixel PX may be less than or equal to a writing time required to write the pixel voltages VP1 to VPn into each row, each group (such as PG1 to PGk), or all of the pixels PX subtracted from a time length of a single frame period (such as the first frame period F1, the second frame period F2, the third frame period F3 or the fourth frame period F4).

In the embodiment above, the common electrode line 145 of the display panel 140 may be switched to the complementary high voltage level VcomH or the complementary low voltage level VcomL row by row or group by group. However, according to an embodiment of the disclosure, all the common electrode lines 145 may be switched to the complementary high voltage level VcomH or the complementary low voltage level VcomL in the meanwhile, so the embodiment of the disclosure is not limited thereto.

Figure 6:
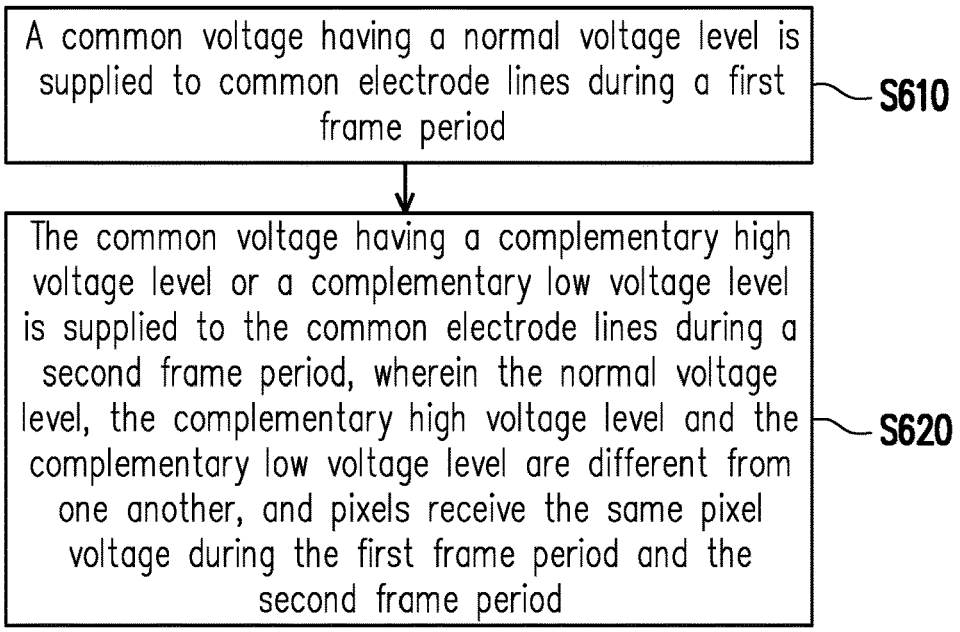
FIG. 6 is a flowchart of a driving method of a display panel according to an embodiment of the disclosure.

FIG. 6 is a flowchart of a driving method of a display panel according to an embodiment of the disclosure. Referring to FIG. 6, in the embodiment, the display panel has the plurality of common electrode lines and the plurality of pixels and receives the plurality of pixel voltages. Each of the pixels is coupled to the corresponding common electrode line, and receives the corresponding pixel voltage. The driving method includes the following steps: In step S610, a common voltage having a normal voltage level is supplied to the common electrode line during the first frame period; in step S620, the common voltage having a complementary high voltage level or a complementary low voltage level is supplied to the common electrode line during the second frame period. The normal voltage level, the complementary high voltage level and the complementary low voltage level are different from one another, and the pixel receives the same pixel voltage during the first frame period and the second frame period. The order of the steps S610 and S620 means that the embodiment of the disclosure is not limited thereto. Moreover, details about the steps S610 and S620 may be found in the embodiments of FIGS. 1 to 5, so a detailed description is omitted.

In view of the above, in the display apparatus and the driving method of the display panel of the display apparatus according to the embodiments of the disclosure, the common voltage having the normal voltage level is supplied to the common electrode line of the display panel during the first frame period, the common voltage having the complementary high voltage level or the complementary low voltage level is supplied to the common electrode line during the second frame period, and the pixel receives the same pixel voltage during the first frame period and the second frame period. For this reason, the viewer on the side of the display panel may see only the grayscale screen of a certain range or the single-grayscale screen. That is, the viewer on the side cannot see the screen normally. In that case, the display apparatus provides the anti-peep function.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A display apparatus comprising:

a display panel, having a plurality of pixels and a plurality common electrode lines and receiving a plurality of pixel voltages, wherein each of the pixels is coupled to a common electrode line of the corresponding common electrode lines, and receives the corresponding pixel voltage; and a common voltage setting circuit, coupled to the common electrode lines;

wherein the common voltage setting circuit supplies a common voltage having a normal voltage level to a first common electrode line and a second common electrode line of the plurality of common electrode lines during a first frame period, the common voltage setting circuit supplies the common voltage having a complementary high voltage level or a complementary low voltage level to the first common electrode line of the plurality of common electrode lines and supplies the normal voltage level to the second common electrode line of the plurality of common electrode lines during a second frame period, the normal voltage level, the complementary high voltage level and the complementary low voltage level are different from one another, and each of the pixels receives the same pixel voltage during the first frame period and the second frame period.

2. The display apparatus of claim 1, wherein when the pixels coupled to each of the common electrode lines are written as the pixel voltages of a positive polarity, each of the common electrode lines receives the common voltage having the complementary high voltage level during the second frame period; when the pixels coupled to each of the common electrode lines are written as the pixel voltages of a negative polarity, each of the common electrodes receives the common voltage having the complementary low voltage level during the second frame period.

3. The display apparatus of claim 2, wherein the complementary high voltage level is higher than the normal voltage level and the pixel voltages of the positive polarity, and the complementary low voltage level is lower than the normal voltage level and the pixel voltages of the negative polarity.

4. The display apparatus of claim 1, wherein during the second frame period, the common voltage received by the corresponding common electrode line is switched from the normal voltage level to the complementary high voltage level or the complementary low voltage level before each of the pixel voltages is written into a corresponding pixel, and the common voltage received by the corresponding common electrode line is switched from the complementary high voltage level or the complementary low voltage level to the normal voltage level after each of the pixel voltages is written into the corresponding pixel.

5. The display apparatus of claim 1, further comprising a source driver configured to provide the pixel voltages for the pixels.

6. The display apparatus of claim 1, further comprising a backlight module configured to provide a display light for the pixels written with the pixel voltages after each of the pixel voltages is written into the corresponding pixel for a liquid crystal response time.

7. The display apparatus of claim 6, wherein a provided time of the display light is less than or equal to a time length of the first frame period or the second frame period subtracted by a writing time required for writing each of the pixel voltages.

8. The display apparatus of claim 1, wherein during the second frame period, one of the common electrode lines receives the common voltage having the complementary high voltage level or the complementary low voltage level, and the rest of the common electrode lines receive the common voltage having the normal voltage level.

9. The display apparatus of claim 1, wherein the common electrode lines are divided into a plurality of common electrode groups, and during the second frame period, the common electrode lines of one of the common electrode groups receive the common voltage having the complementary high voltage level or the complementary low voltage level, and the common electrode lines of the rest of the common electrode groups receive the common voltage having the normal voltage level.

10. A driving method of a display panel, the display panel having a plurality of common electrode lines and a plurality of pixels and receiving a plurality of pixel voltages, each of the pixels being coupled to a corresponding common electrode line of the common electrode lines and receiving the corresponding pixel voltage, the driving method comprising:

supplying a common voltage having a normal voltage level to a first common electrode line and a second common electrode line of the plurality of common electrode lines during a first frame period; and supplying the common voltage having a complementary high voltage level or a complementary low voltage level to the first common electrode line of the plurality of common electrode lines and supplies the normal voltage level to the second common electrode line of the plurality of common electrode lines during a second frame period; wherein the normal voltage level, the complementary high voltage level and the complementary low voltage level are different from one another, and each of the pixels receives the same pixel voltage during the first frame period and the second frame period.

11. The driving method of claim 10, further comprising:

receiving the common voltage having the complementary high voltage level by each of the common electrode lines during the second frame period when the pixels coupled to each of the common electrode lines are written with the pixel voltages of a positive polarity.

12. The driving method of claim 11, wherein the complementary high voltage level is higher than the normal voltage level and the pixel voltages of the positive polarity.

13. The driving method of claim 10, further comprising:

receiving the common voltage having the complementary low voltage level by each of the common electrode lines during the second frame period when the pixels coupled to each of the common electrode lines are written with the pixel voltages of a negative polarity.

14. The driving method of claim 13, wherein the complementary low voltage level is lower than the normal voltage level and the pixel voltages of the negative polarity.

15. The driving method of claim 10, further comprising:

switching the common voltage received by the corresponding common electrode line from the normal voltage level to the complementary high voltage level or the complementary low voltage level during the second frame period before each of the pixel voltages is written into the corresponding pixel; and switching the common voltage received by the corresponding common electrode line from the complementary high voltage level or the complementary low voltage level to the normal voltage level during the second frame period after each of the pixel voltages is written into the corresponding pixel.

16. The driving method of claim 10, further comprising:

supplying a display light to the pixels of the pixel voltages after each of the pixel voltages is written into the corresponding pixel for a liquid crystal response time.

17. The driving method of claim 16, wherein a provided time of the display light is less than or equal to a writing time required to write each of the pixel voltages subtracted from a time length of the first frame period or the second frame period.

18. The driving method of claim 10, wherein during the second frame period, one of the common electrode lines receives the common voltage having the complementary high voltage level or the complementary low voltage level, and the rest of the common electrode lines receive the common voltage having the normal voltage level.

19. The driving method of claim 10, wherein the common electrode lines are divided into a plurality of common electrode groups, and during the second frame period, the common electrode lines of one of the common electrode groups receive the common voltage having the complementary high voltage level or the complementary low voltage level, and the common electrode lines of the rest of the common electrode groups receive the common voltage having the normal voltage level.

* * * * *